US005277205A

United States Patent [19]

Jenkins

[11] Patent Number: 5,277,205

[45] Date of Patent: Jan. 11, 1994

[54] METHOD AND APPARATUS FOR APPLYING DECORATION TO NAILS

[75] Inventor: Nevin Jenkins, Homosassa, Fla.

[73] Assignee: Fashion Nails, Inc., Miami, Fla.

[21] Appl. No.: 65,506

[22] Filed: May 24, 1993

Related U.S. Application Data

[63] Continuation of Ser. No. 830,321, Jan. 31, 1992, abandoned.

[51] Int. Cl.[5] ..... A45D 24/00

[52] U.S. Cl. ..... 132/200; 132/73; 132/73.5

[58] Field of Search ..... 132/73, 73.5, 74, 200, 132/285, 319, 320, 333

[56] References Cited

U.S. PATENT DOCUMENTS

| | | | |
|---|---|---|---|
| 2,031,225 | 2/1936 | O'Donnell | 132/285 |
| 2,180,519 | 11/1939 | Hamilton et al. | 132/285 |
| 2,220,785 | 11/1940 | Florio | 132/285 |
| 2,262,977 | 11/1941 | Vasil | 132/285 |
| 2,287,062 | 6/1942 | Powers et al. | 132/285 |
| 2,296,795 | 9/1942 | Landsman | 132/320 |
| 2,454,004 | 11/1948 | Pettyjohn | 132/285 |
| 2,485,384 | 10/1949 | Klein | 132/285 |
| 2,580,893 | 1/1952 | Dee | 132/285 |
| 2,735,435 | 2/1956 | Feinstein | 132/320 |
| 2,799,282 | 7/1957 | Slack | 132/285 |
| 3,461,885 | 8/1969 | Coveney | 132/285 |
| 3,480,020 | 11/1969 | Ernest | 132/74.5 |
| 3,515,154 | 6/1970 | La Morgese | 132/285 |

*Primary Examiner*—Gene Mancene
*Assistant Examiner*—Frank A. LaViola
*Attorney, Agent, or Firm*—Keck, Mahin & Cate

[57] ABSTRACT

Method and apparatus for making a decorative pattern on a finger or toe nail using a fixture that receives a stencil and holds it in juxtaposition to a nail. Articulated arms position the fixture on the finger or toe, with the nail exposed through the fixture. A stencil is inserted into the fixture. A coloring liquid is put onto the stencil and is expressed through the stencil by a squeegee that coacts with the fixture. Multi-color patterns can be made by using a plurality of stencils with different coloring liquids, such as nail polishes or lacquers.

11 Claims, 2 Drawing Sheets

METHOD AND APPARATUS FOR APPLYING DECORATION TO NAILS

This is a continuation of application Ser. No. 07/830,321, filed Jan. 31, 1992, now abandoned.

FIELD OF INVENTION

The present invention relates to a method and apparatus for applying colors and patterns to finger and toe nails for decorative purposes.

BACKGROUND OF INVENTION

Although coloring or otherwise decorating finger and toe nails with patterns is a common practice, always this is done manually in a painstaking and tedious manner No apparatus or method exists for effecting such decoration in an expeditious fashion.

SUMMARY OF INVENTION

The present invention provides a method and apparatus for applying color or decorative patterns to finger or toe nails in an expeditious fashion. This is accomplished by apparatus in the form of a fixture or jig that can be detachably mounted on a finger or toe in suitable juxtaposition to a finger nail or toe nail which cooperates with a stencil or screen holder that is held in the properly spaced juxtaposition relative to the nail undergoing decoration. An applicator coacts with both the fixture and a stencil or screen mounted in the holder to apply to the nail a liquid decoration such as a quick drying nail lacquer or polish.

The method comprises establishing a well above a nail to be treated or decorated, resiliently positioning a stencil or screen in the well in proper juxtaposition to the nail, slightly spaced above it, introducing a decorating liquid, such as nail polish, into the well on the stencil or screen and depressing and biasing the stencil or screen toward the nail while expressing an appropriate amount of the liquid through the biased stencil or screen to create the decorative pattern or at least a portion thereof on the nail. By changing stencils and using different color nail polishes or lacquers, multi-color patterns can be made.

DETAILED DESCRIPTION OF PREFERRED EMBODIMENT

Figure 2:
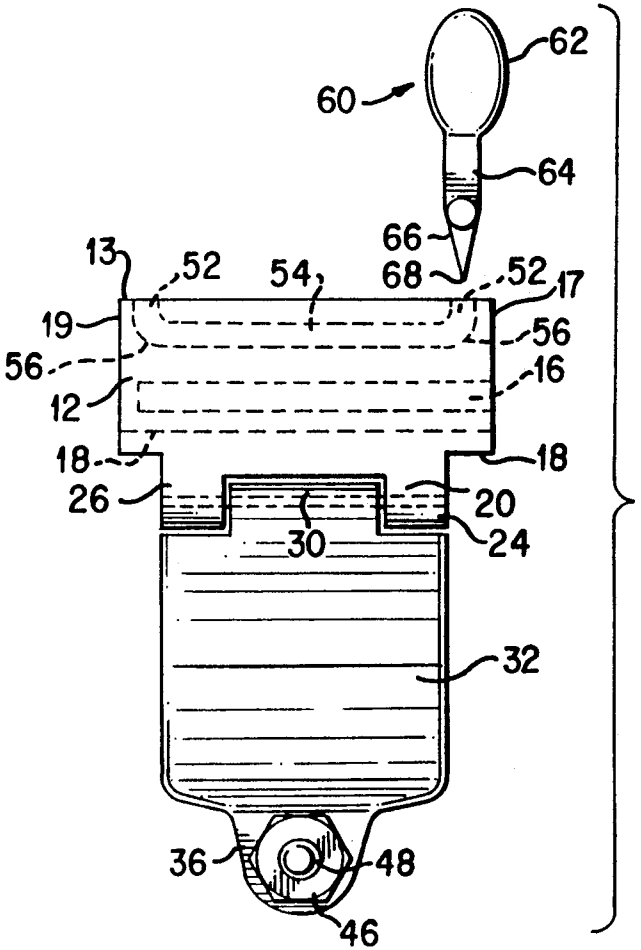
FIG. 2 is a view in end elevation of the novel apparatus shown in FIG. 1.
Figure 1:
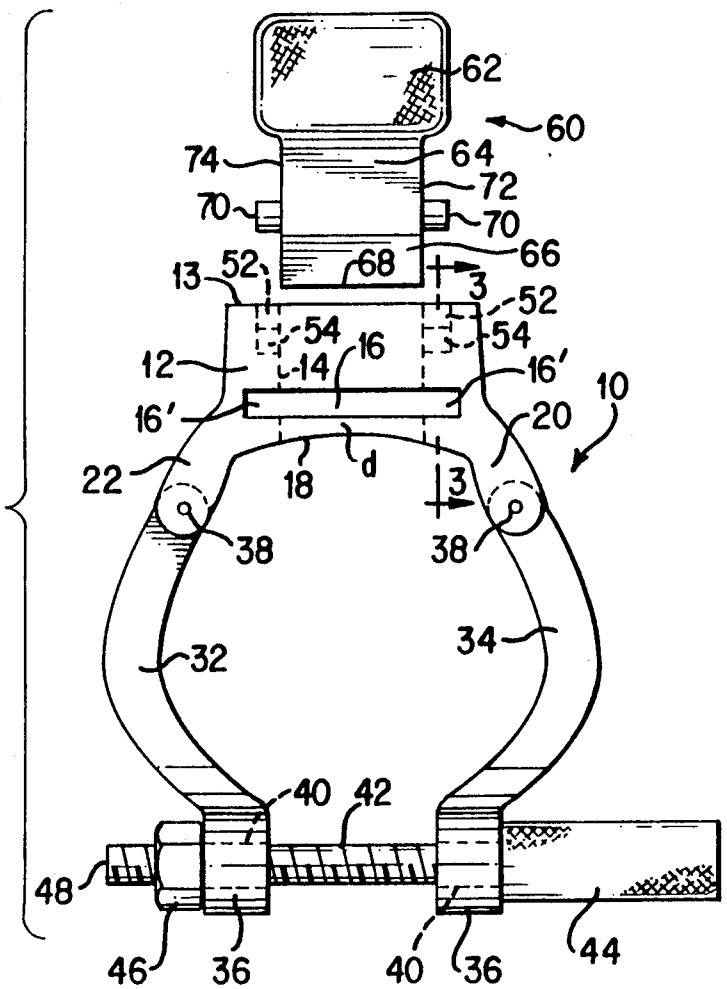
FIG. 1 is a view in side elevation showing the novel fixture and coacting squeegee.
Figure 3:
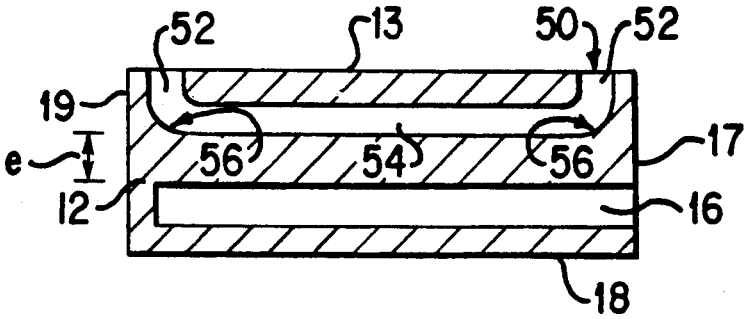
FIG. 3 is a view in cross section taken along line A—A of FIG. 1.

Referring now to the drawings in detail FIGS. 1–3 show the novel apparatus. A fixture or jig 10 consists of a parallelepiped main body 12 having a vertically extending through bore 14 of square or rectangular cross section that serves as a well. A bore or slot 16 extends horizontally into main body 12 from one side 17 spaced a predetermined distance d above the bottom 18 of the main body 12 and terminates spaced from opposite side 19. Bottom 18 is arcuate and curves to the same extent or degree as a finger nail or a toe nail. Slot 16 is wider than well 14 with portions 16' extending into main body 12 on both sides of well 14.

The bottom 18 of main body 12 is bifurcated to form depending legs 20 and 22. Each leg is bifurcated to form ears 24 and 26 spaced apart on each side of their associated leg. Fitted into the space defined between each pair of ears 24 and 26 is the reduced section 30 of an arcuate pincer arm 32, 34. Arms 32, 34 are wide bands, as shown in FIG. 2 and terminate at their lower ends in narrowed ears 36 centrally located and vertically depending.

Hinge pins 38 extend through ears 24, 26 and reduced section 30 to enable arms 32, 34 to articulate or pivot relative to main body 12. The ears 36 are each provided with a horizontal through bore 40 and a threaded shaft or screw 42 provided with a knurled handle 44 fixed to one end passes through bores 40. A nut 46 is threaded onto screw 42 at its free end 48. Handle 44 is of larger diameter than screw 42 and bore 36 as is nut 46 so that ears 36 can be drawn together by relative manipulation of nut 46 and handle 44, screw 42 or allowed to move apart.

A slot 50 is formed in main body 12 on opposite sides of well 14, over the extended regions 16' of slot 16. Each slot 50 has two vertically extending, horizontally spaced portions 52 which originate at top surface 13 of main body 12 and are joined by connecting portion 54 which extends horizontally spaced a predetermined distance e above the slot 16. Slot 50 is of uniform cross section and the transitions 56 between portions 52 and 54 are smoothly curved.

A broad squeegee 60 consisting of a bulbous top 62, a shank 64 and a lower terminating blade 66 that tapers gradually from shank 64 to a pointed edge 68, is provided with a pair of projecting pins 70 extending from either side 72, 74 of the broad face of the squeegee 60. The width of squeegee 60 is equal to or slightly less than the width of well 14, see FIG. 1, to fit into it loosely. Pins 70 are of slightly lesser diameter than slot 50 so that pins 70 can readily traverse the slots 50. When pins 70 are traversing portion 54, blade 66 and more particularly edge 68 intrudes into or below slot 16.

Figure 4:
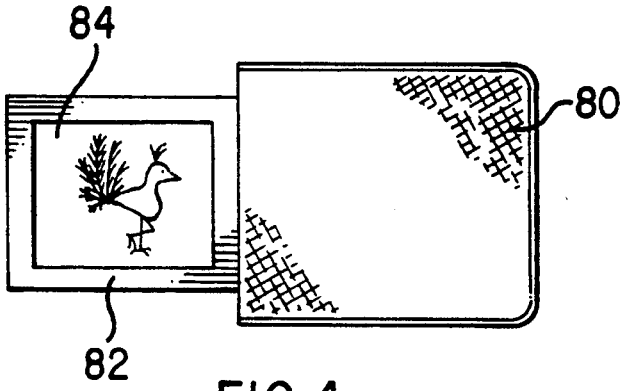
FIG. 4 is a plan view of a novel stencil holder with stencil.
Figure 5:
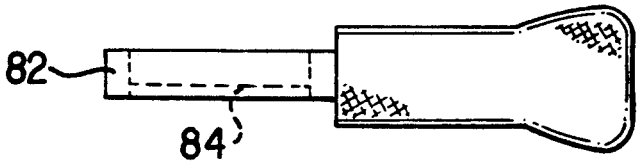
FIG. 5 is a side view of the novel stencil holder of FIG. 4.

As shown in FIGS. 4 and 5, a stencil frame consists of a flat knurled handle 80 from which extends a rectangular frame 82 in which is mounted a stencil 84 stretched under slight tension or pressure along the bottom edge of the frame 82. Alternatively, the stencil 84 can be in a separate frame and received in a rectangular frame holder provided with handle 80. In this way, replacement of a stencil can be effected without replacing the entire assembly of the frame holder and handle. The stencil frame is loaded into the main body 12 by inserting the frame 82 in the slot 16 which is sized so that frame 82 is easily inserted but the fit is snug without relative movement.

The method of the invention consists of the steps of positioning the fixture 10 on a nail such as a finger nail by inserting the finger into the opening defined by the bottom 18, arms 32, 34 and screw 42 with the nail in contact with bottom 18 and therefore a portion of the nail exposed in the bottom of well 14. A stencil frame is loaded into slot 16 by inserting frame 82 using handle 80. This places a stencil 84 at the bottom of slot 16 directly over the portion of the nail exposed in the bottom of well 14, spaced above the nail by a distance d. Next, a coloring liquid is placed onto stencil 84, frame 82 acting at this time as a well for such liquid. Next, squeegee 60 is inserted into main body 12 by placing pins 70 into slots 50 on one side, say for example, slot portions 52 nearest side 17. When pins 70 traverse associated transitions 56 and enter slot portions 54, the edge 68 of squeegee 60 is depressing stencil 84 (which is resilient) down onto the exposed nail portion. As pins 70 and squeegee 60 is drawn horizontally in slot portions 54 toward side 19 (away from side 17), the coloring liquid is expressed through stencil 84 to duplicate the stencil pattern on the nail. As edge 68 moves it depresses the stencil 84 successively in the traversing direction, while progressively releasing the stencil 84 in the direction opposite to traversing. Therefore, only a narrow line or strip of stencil 84 contacts the nail at any given time interval, avoid prolonged contact and preventing any smearing of the pattern from occurring.

When one stencil has been used, it can be withdrawn and replaced with another stencil and so forth. In this manner multi-color patterns can be rapidly, neatly and expeditiously created.

The slot 16 can be arcuate instead of straight in which case frame 82 and blade 66, edge 68 will also be arcuate to the same curve or radius. Further, whereas coloring liquids such as nail polishes and lacquers are described, colorless liquids can also be used in conjunction with particles or powders which when sprinkled onto a colorless liquid will be bonded thereto to create a pattern on the nail.

Although the invention has been described in terms of a preferred embodiment, changes are possible which do not depart from the teaching of the invention, such are deemed to fall within the purview of the appended claims.

What is claimed is:

1. Apparatus for making a decorative pattern on a finger or toe nail comprising a) a fixture for receiving a resilient screen in juxtaposition to a nail, b) position means for positioning said fixture on a finger or toe, c) a resilient screen to be received in said fixture, and d) expressing means coacting with said resilient screen and said fixture for resiliently deflecting said screen toward in nail located in juxtaposition to the fixture and for expressing a coloring liquid contained on said resiliently deflected screen through said resilient screen onto the nail.

2. Apparatus according to claim 1 wherein said positioning means includes arms articulated at one end to said fixture and a tightening means for drawing said arms together.

3. Apparatus according to claim 2 wherein said tightening means includes a threaded screw and nut coacting with the free ends of the arms.

4. Apparatus according to claim 1 wherein the resilient screen is held in a frame provided with a handle.

5. Apparatus according to claim 1 wherein the fixture includes a main body having a bottom surface, a top surface and two opposed side surfaces, a vertical through bore defined in said main body, a first horizontal slot defined in said main body wider than the through bore and spaced above the bottom surface by a predetermined amount, a second and third slots, one on each side of said through bore, each have a pair of spaced vertical portions leading from the top surface and an interconnecting horizontal portion space above the first slot by a predetermined amount and wherein the expressing means is a squeegee having a pair of projecting pins to coact with the second and third slots and a blade to coact with the resilient screen as the pins traverse the interconnecting horizontal portions of the second and third slots.

6. Apparatus according to claim 5 wherein the transition between each vertical portion and interconnecting horizontal portion curves smoothly.

7. Apparatus according to claim 1 wherein the fixture is provided with a slot to hold the resilient screen.

8. Apparatus according to claim 7 wherein the slot and flexible screen are arcuate in shape.

9. A method for making a decorative pattern on a nail such as a finger nail or toe nail comprising the steps of a) positioning the fixture on a finger or toe nail capable of holding a resilient screen in juxtaposition relative thereto, b) inserting a resilient screen in the fixture, c) introducing a coloring liquid onto the resilient screen where it will be held thereon, d) resiliently deflecting the resilient screen toward the nail while expressing the liquid through the resiliently deflected screen to transfer coloring liquid onto the nail in the pattern of the resilient screen.

10. The method of claim 9 wherein the expression occurs as a line advance with the resilient screen contacting the nail only on a line as it advances.

11. The method of claim 9 wherein multi-color patterns are created by successively replacing the resilient screen with a new resilient screen and repeating steps b) and c).

* * * * *